US006655108B2

(12) United States Patent
Larson et al.

(10) Patent No.: US 6,655,108 B2
(45) Date of Patent: Dec. 2, 2003

(54) DOOR WITH LOCKSET

(75) Inventors: Oscar Dale Larson, Brookings, SD (US); Allen E. Lee, Brookings, SD (US); Bryan P. Zacher, Brookings, SD (US); Bruce E. Thomas, Brookings, SD (US)

(73) Assignee: Larson Manufacturing Company, Brookings, SD (US)

( * ) Notice: Subject to any disclaimer, the term of this patent is extended or adjusted under 35 U.S.C. 154(b) by 60 days.

(21) Appl. No.: 10/010,953

(22) Filed: Dec. 7, 2001

(65) Prior Publication Data

US 2002/0092264 A1 Jul. 18, 2002

Related U.S. Application Data

(60) Provisional application No. 60/254,325, filed on Dec. 8, 2000.

(51) Int. Cl.[7] ..... E04C 2/54

(52) U.S. Cl. ..... 52/784.1; 292/1; 292/337; 292/DIG. 2

(58) Field of Search ..... 292/1, 337, DIG. 53, 292/DIG. 2; 52/784.1, DIG. 12; 49/380; 206/325; 220/242; 174/66, 67

(56) References Cited

U.S. PATENT DOCUMENTS

| | | | | | |
|---|---|---|---|---|---|
| 867,574 | A | * | 10/1907 | Egge | 292/337 |
| 2,785,565 | A | * | 3/1957 | Schlage | 292/337 |
| 5,077,948 | A | | 1/1992 | Olson et al. | |
| 5,161,346 | A | | 11/1992 | Olson et al. | |
| 5,722,203 | A | * | 3/1998 | Staples et al. | 49/380 |
| 5,839,252 | A | * | 11/1998 | Berghorn et al. | 52/784.13 |

* cited by examiner

*Primary Examiner*—Carl D. Friedman
*Assistant Examiner*—Nacho Slack
(74) *Attorney, Agent, or Firm*—Welsh & Katz, Ltd.

(57) ABSTRACT

A storm door has first and second elongated, partly curved lock receiving openings formed in respective elongated edges. Each opening is filled in part with a molded hollow insert with an external periphery which matches a periphery of the respective opening. A lock mechanism has a housing with an external periphery that matches, at least in part, an internal periphery of a respective insert. An actuating port in the housing has a central axis, which extends parallel to the respective edge, through the door through which extends a rotatable actuating shaft. An external handle can be attached to the shaft. An unused insert can be closed with a slidably engaging cover.

34 Claims, 10 Drawing Sheets

DOOR WITH LOCKSET

This application claims the benefit of provisional application U.S. Ser. No. 60/254,325 filed Dec. 8, 2000.

FIELD OF THE INVENTION

The invention pertains to doors. More particularly, the present invention pertains to storm doors and structures for supporting mortise locks within storm doors.

BACKGROUND OF THE INVENTION

The architectural location of storm doors tends to dictate that they exhibit relatively small depth so as to be light weight and easily installable in a variety of applications. They must be sufficiently strong to withstand substantial forces due to opening and closing as well as impact forces as various objects are moved near or through the respective door frames. They must also withstand slamming of the door by the users and withstand strong winds.

The doors must remain effective and operable over wide temperature ranges and humidity conditions. They must withstand the deteriorating effects of variations in weather over long periods of time while retaining an acceptable appearance.

To meet the above criteria, a variety of different materials have been used for storm doors. Known storm doors can be formed of wood, particle board, medium density fiberboard, honeycombed material, vinyl, foam filled styrene, composite wood, engineered wood-type materials, as well as foamed resins. Often a combination of these materials is used. Other types of particulate material as well as other polymer based materials have also been used.

Representative storm door structures have been disclosed in U.S. Pat. Nos. 5,161,346 and 5,077,948 assigned to the assignee of the present application. Those patents are incorporated herein by reference.

Storm doors usually include some form of a lock mechanism so as to enable the consumer or home owner to lock the storm door and leave the interior, primary solid security door open. Mortise lock assemblies have been used in known storm doors.

One such configuration has been disclosed and claimed in U.S. patent application Ser. No. 09/911,604 entitled Wood Core Exterior Door With Mortise Lock filed Jul. 24, 2001 and assigned to the assignee hereof. That application is incorporated herein by reference. In the subject application, in one embodiment, multiple sections of a stile are combined with a lock receiving container to form unitary stiles. The unitary stiles can be combined with rails or kick plates to form a door.

While the structure of the above-noted application, incorporated herein by reference, is useful and effective for its intended purpose, in some door designs, unlike the door disclosed in the above-noted application, a unitary core is used. Alternately, unitary stiles can be used. In such designs where the edges of the core or the stiles are bored or drilled for the purpose of installing mortise-type locks, potential problems may arise given the thickness of the core or the stiles versus the width of the borings or openings necessary to receive the lock. Hence, care must be taken not to weaken the respective core or stile in the vicinity of where the mortise lock is to be installed.

There thus continues to be a need for storm doors bored to receive mortise locks in such a way as to maximize available cross sectional strength of the door, in the vicinity of the boring for the mortise lock. In addition, in doors with moisture absorbing cores, wood or wood-like cores, it would be desirable to prevent moisture from traveling from a lock or lock cavity into the door core.

SUMMARY OF THE INVENTION

The invention provides an improved door construction, such as for a storm door. The door includes right and left vertical members, a head panel and a base panel or, rails. Alternately, the door can have a unitary core with cut-outs for glass or screen inserts.

The vertical edges each have an elongated opening or slot having curved ends joined by planer sides such that the available cross sectional strength of the respective door is maximized in the vicinity of the boring. With molded cores, appropriately shaped elongated openings can be molded in spaced apart vertical core edges. In a preferred embodiment, a ratio of the radius of the ends of the slot to the width thereof exceeds 0.4.

In one disclosed embodiment, a metal or plastic sleeve can be slid into and frictionally retained within a respective opening or slot to provide a moisture seal and prevent moisture from the lock or the slot(s) from migrating into the core as well as to improve strength and stability of the respective core or door.

The sleeves can each carry stile or core engaging protrusions which extend laterally from the respective sides of the sleeve to improve retention force. Alternately, the sleeves can be held in place with adhesive. A sealant can be incorporated between the opening and the sleeve to further enhance moisture resistance.

In a disclosed embodiment, a narrow mortise lock having a live bolt with a height on the order of ¾–⅞ of an inch can be installed in the opening with or without a sleeve. Where used with a sleeve, the lock can have a housing which extends into the sleeve, and, has an exterior cross section which matches an interior cross section of the sleeve. Alternately, the mortise lock can be sized and shaped to be used without a sleeve or insert and can be installed directly into the elongated opening.

In a preferred embodiment, both edges of the door are bored substantially identically. Depending on which side of the door is hinged, that respective opening can be closed with a snap-fit cover.

The present invention is especially advantageous when embodied in doors, with a width less than one inch, on the order of ¾ of an inch thick. In such embodiments, the slot or opening, as a result of its cross section, can be formed in the edge of the core with a width on the order of five-eights of an inch with five-sixteenth inch end radii. The end radii which result, for example in semicircular cylindrical end regions, provide greater core strength in the vicinity of the ends than would be available in the presence of substantially square corners.

The width of the opening can be filled with a sleeve in combination with a narrow mortise lock. The sleeve can be separate from or attached to the mortise lock. Alternately, the lock can be sealed and sized to slidably fit into the opening without a sleeve.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1A:
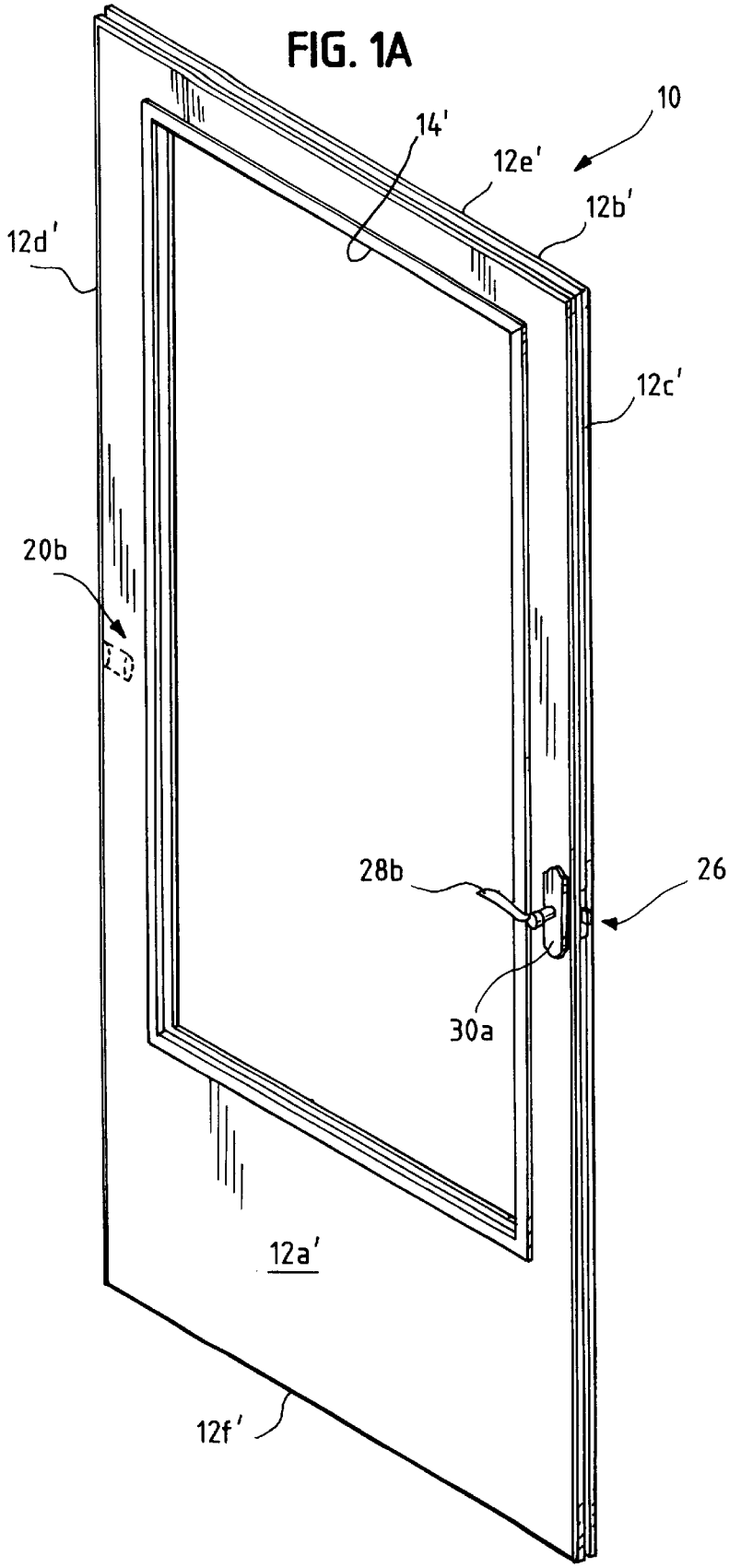
FIG. 1A is an isometric view of a door in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Figure 1B:
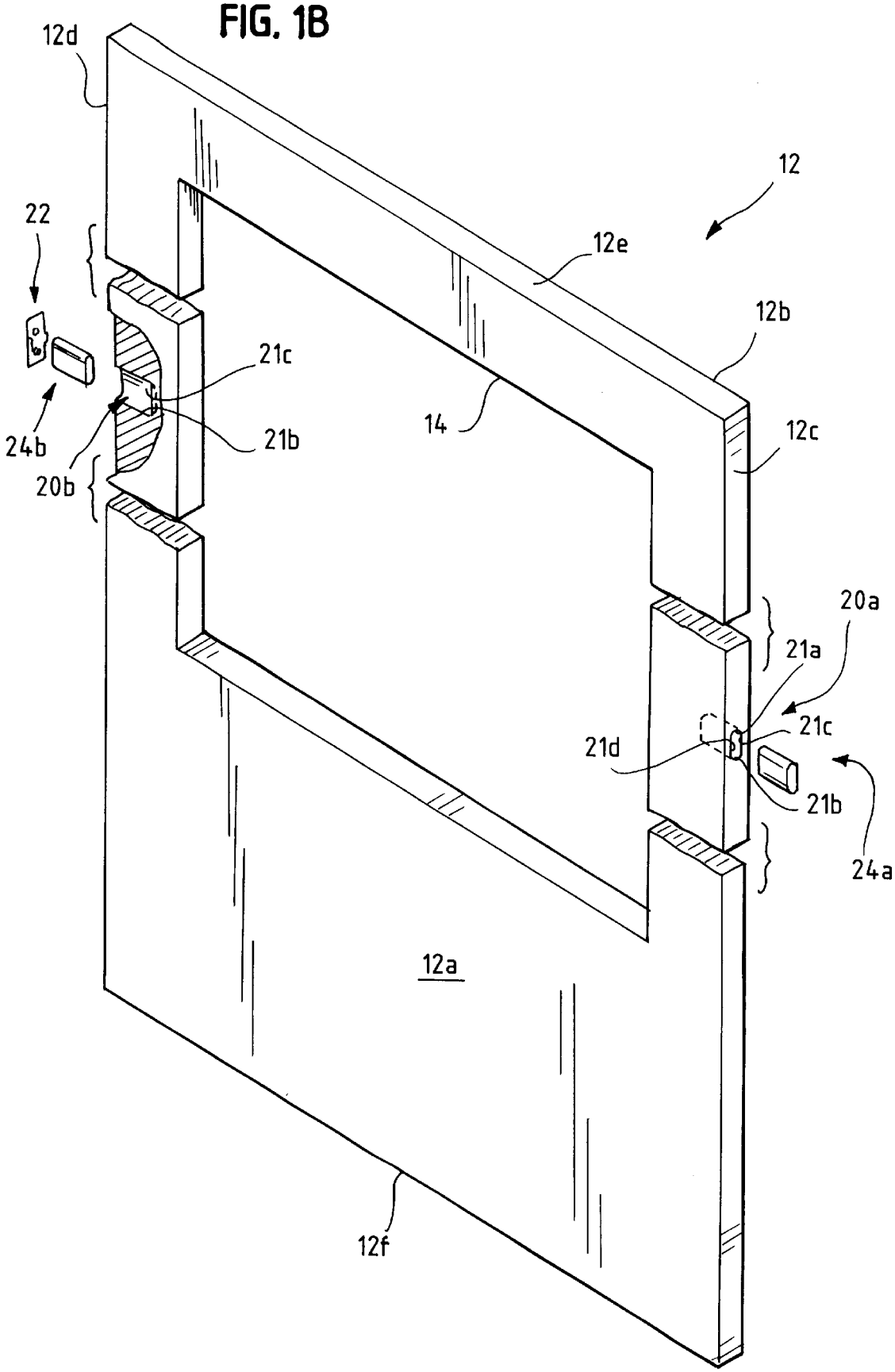
FIG. 1B is an enlarged, partial, exploded isometric view of a core for the door of FIG. 1A.
Figure 1C:
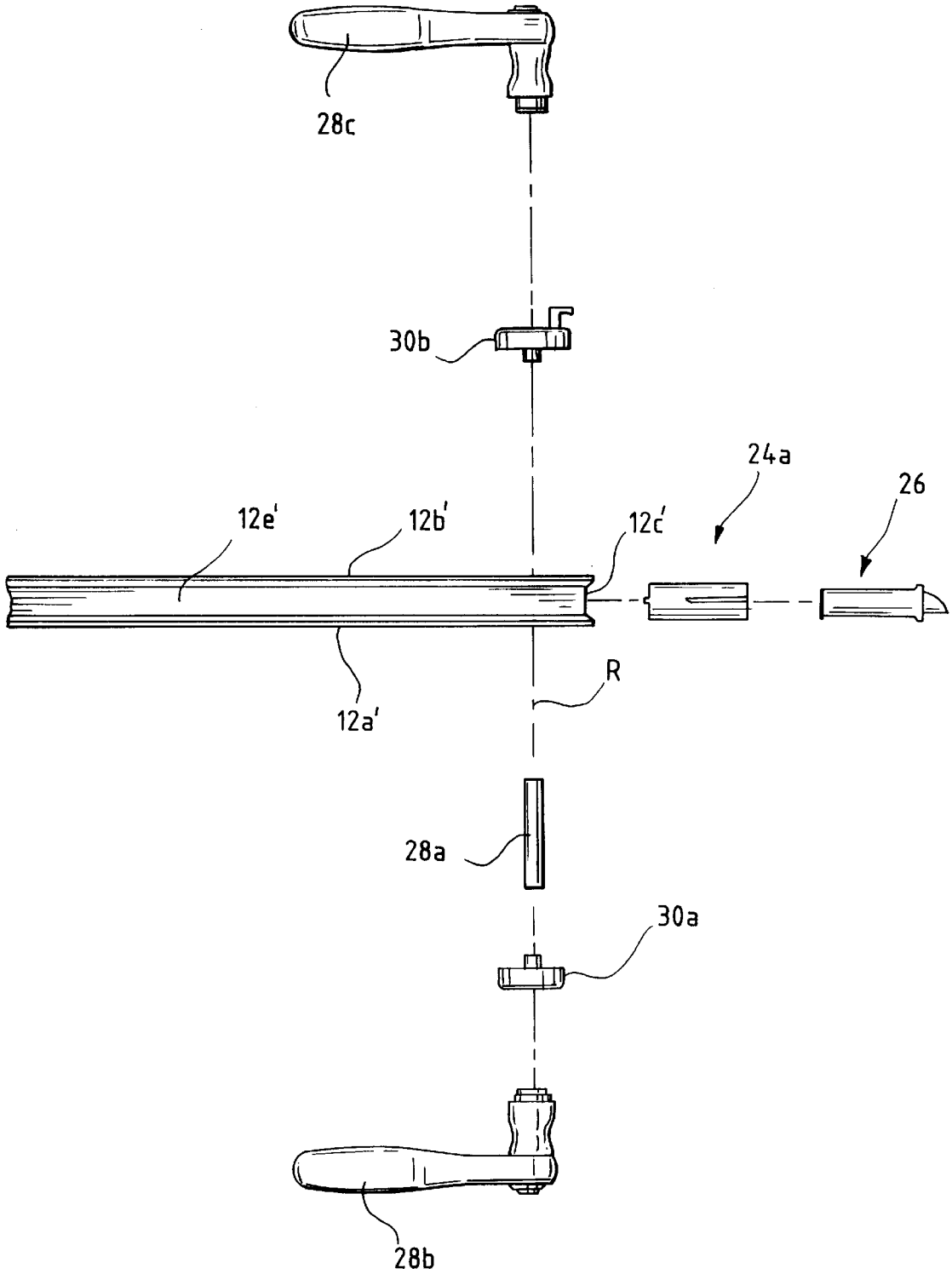
FIG. 1C is an exploded top plan view of a portion of the door of FIG. 1A.
Figure 2:
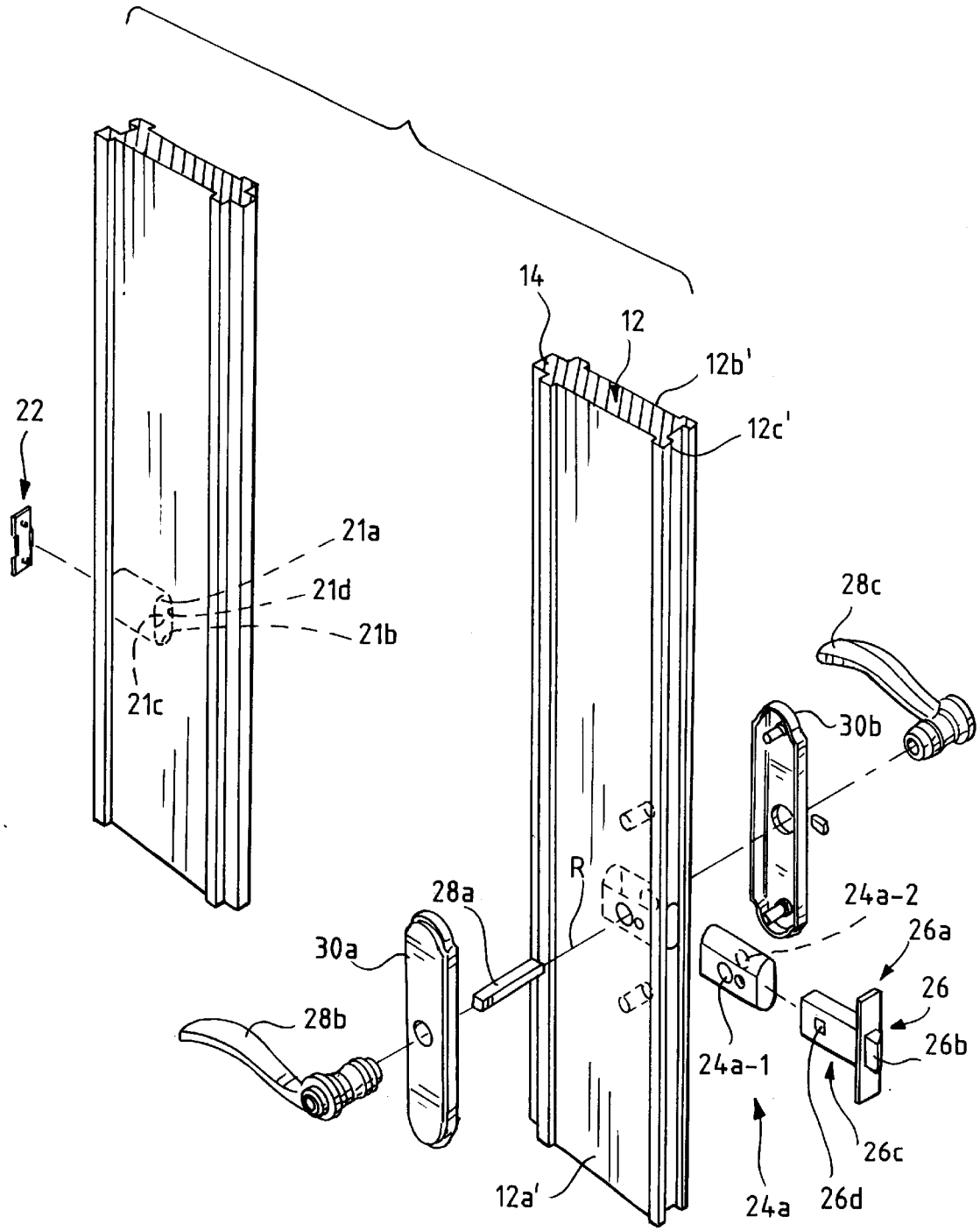
FIG. 2 is a partial, exploded, enlarged isometric view of a portion of the door of FIG. 1A.

FIGS. 1A, 1B and 1C illustrate respectively isometric, exploded and top plan exploded views of a storm door 10 in accordance with the present invention. The door 10 includes a core, indicated generally at 12, best seen in FIG. 1B, which could be formed as a single unitary structure with a central cut-out region 14 formed therein for receipt of glass or screen inserts of a type normally used with storm doors as would be understood by those of skill in the art. Alternately, the core 12 can be formed of a plurality of severally assembled elements such as vertical stiles, kick panel and top rail which can be assembled together to form a core with an opening corresponding to the opening 14. Also as would be understood by those of skill in the art, the core 12 for the storm door 10 can be covered on its exterior and interior faces, such as 12*a*, 12*b* as well as edges 12*c, d, e* and *f* with sheet metal such as aluminum, 12*a′, b′, c′, d′, e′* and *f′* to improve appearance as well as to improve resistance to the elements.

The core 12 can be formed of a variety of materials such as wood, particle board, medium density fiberboard, honeycombed materials, vinyl, foam filled styrene, composite wood, engineered wood-type materials as well as foamed resins. Other types of particulate material as well as other polymer based materials can also be used.

The door 10 includes first and second substantially identical elongated slots or openings 20*a*, 20*b* formed in the respective edges 12*c*, 12*d*. The slots or openings 20*a*, 20*b* are elongated and preferably with semicircular ends 21*a, b* best seen in FIG. 5B. The curved end regions are joined by two elongated planer sides 21*c, d*.

For example, and without limitation, where the width of the core 12 for the door 10 is on the order of three-quarters of an inch wide, the openings 20*a*, 20*b* can be formed as five-eights inch wide slots with five-sixteenth inch radius circular end regions. Representative maximal lengths of the slots are on the order of 1.3 inches long.

As a result of providing slots 20*a*, 20*b* along each edge of the door 10, the door can readily be hinged on either edge. The unused slot can be covered by a snap-in cover 22. Exterior sheeting, such as 12*c′*, 12*d′* can be slotted with a similar or square cross section.

The door 10 is especially advantageous in that despite its narrowness, on the order of less than one inch, preferably three-quarters of an inch wide, the form of the slots 20*a*, 20*b*, with the semicircular ends 21*a, b* noted above, leaves additional material in the core that would not otherwise be present, thereby increasing the cross-sectional strength of the core in the vicinity of the slots 20*a*, 20*b* beyond what would be case for a substantially square slot. Hence, the semicircular end regions 21*a, b* for the slot 20*a* contribute to door strength, more so than square slots, in the presence of a narrow core.

Figure 3A:
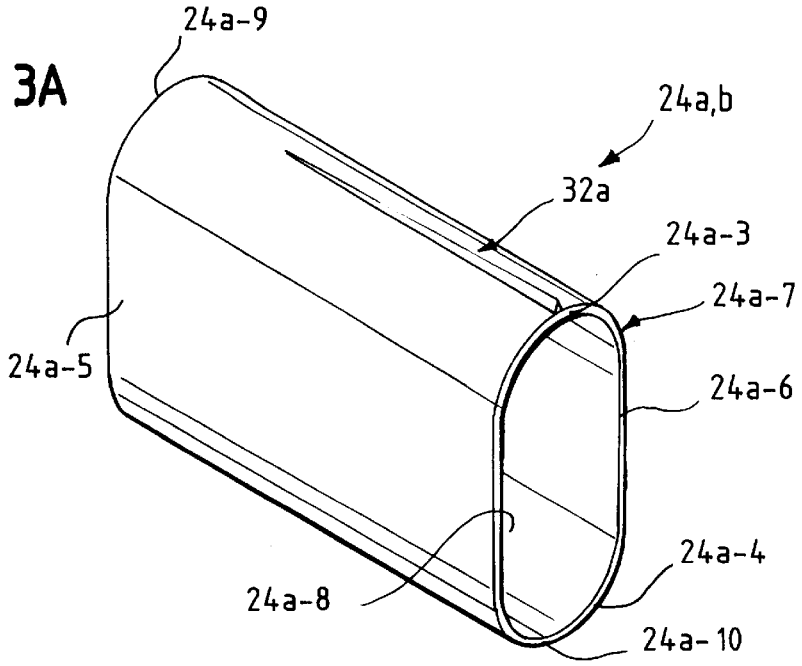
FIGS. 3A–3E illustrate various views of a sleeve usable in the door of FIG. 1A.
Figure 3B:
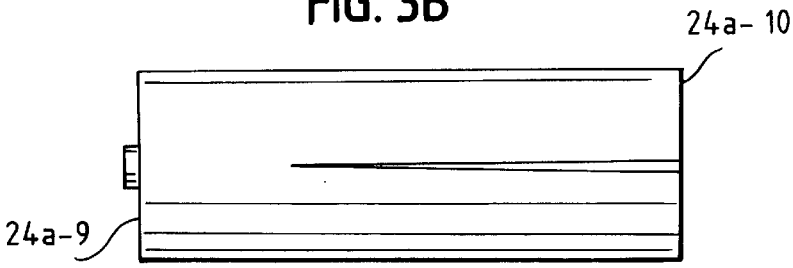
Figure 3E:
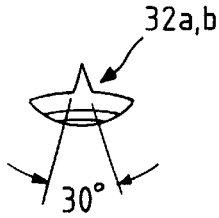
Figure 3C:
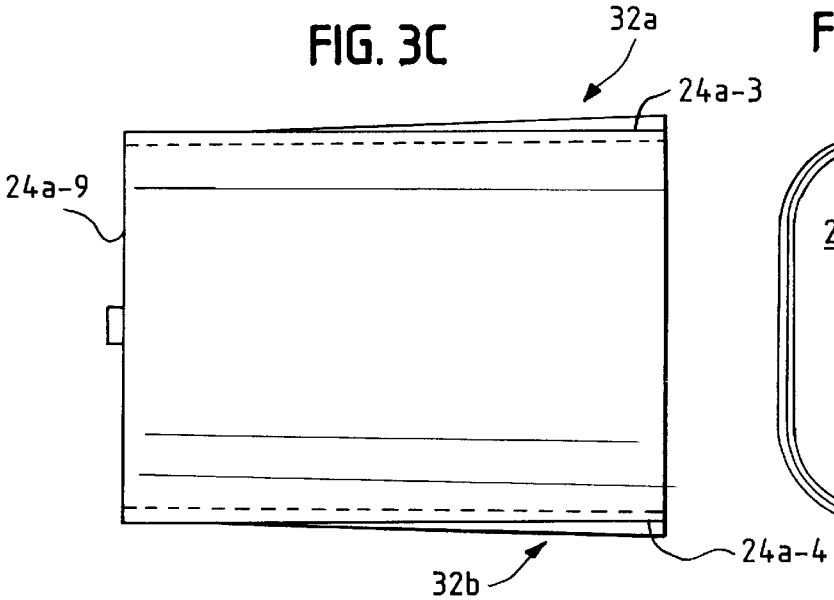
Figure 3D:
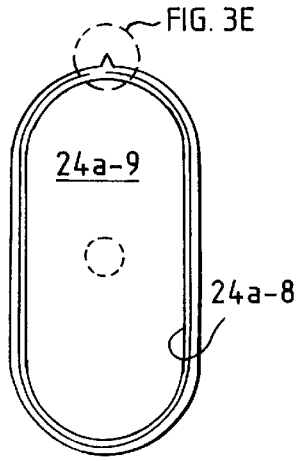

The door 10 also includes first and second plastic or metal sleeves or inserts 24*a*, 24*b*, best seen in FIGS. 1B, 3A, which slide into and fill the respective elongated slots 20*a*, 20*b*. The sleeves or inserts 24*a*, 24*b* both provide a moisture seal relative to the slots 20*a*, 20*b* such that moisture entering or present within the respective insert 24*a*, 24*b* is blocked from migrating into the core 12 in the vicinity of the slots. Additionally, the presence of the sleeves 24*a*, 24*b* provides additional strength and stiffening for the door in the vicinity of the respective slots 20*a*, 20*b* thereby improving door strength.

A mortise lock 26 is slidably positioned in a respective sleeve, such as the sleeve 24*a* in the slot 20*a*. Lock 26 can be slidably received in the sleeve 24*a* with a friction fit or, alternately, can be attached to the edge 12*e* of the core 12 through sheet 12*e′*, by screws or other fasteners via integrally attached plate 26*a*. It will be understood that the lock 26 can be sized to take advantage of the narrow elongated insert 24*a*, as discussed subsequently.

The lock 26 incorporates a live bolt 26*b* which moves laterally in a housing 26*c* from an extended, locked position to a retracted position. A mechanism within the housing 26*c* couples the live bolt 26*b* to a rotary actuating port 26*d* which has an axis of rotation R.

The actuating port 26*d* includes an opening with a square cross section which receives an actuating shaft or spindle 28*a* which has a corresponding square cross section. The shaft or spindle 28*a* is in turn coupled to rotatable handles 28*b* and 28*c* which in turn are attached to the door 10 via escutcheons 30*a*, 30*b*.

Rotating either handle 28*b* or handle 28*c* in turn rotates shaft or spindle 28*a* which extends through the port 26*d* on the axis R. This in turn retracts the live bolt 26*b* from an extended, locking position to a retracted, unlocking position. Releasing the respective handle permits a spring or biasing element in housing 26*c* to restore bolt 26*b* to its locking position.

The shaft or spindle 28*a* extends through openings 24*a*-1, -2 in the side walls of a respective sleeve such as the sleeve 24*a*.

FIGS. 3A–3E illustrate various views of insert 24*a*. Insert 24*b* is substantially identical to insert 24*a*. A discussion of insert 24*a* applies to both.

The insert 24*a* includes first and second curved end walls 24*a*-3 and 24*a*-4. The end walls 24*a*-3, -4 are joined by spaced-apart planer side walls 24*a*-5 and 24*a*-6. The elongated exterior shape of the insert 24*a* slidably matches and engages the elongated respective slot, such as the slots 24*a, b* in the door 10.

The insert 24*a* is formed with a substantially constant wall thickness 24*a*-7 and encloses a bounded lock receiving region 24*a*-8. The insert 24*a* is closed with an end wall 24*a*-9 which is distally located relative to the slot 20*a* such that the end wall 24*a*-9 is located in the vicinity of an end wall of the respective slot 20*a*.

First and second core engaging protrusions 32*a, b* extend laterally from the insert 24*a* and slidably engage the core 12 with a friction fit when the insert 24*a* is driven into the slot 20*a*. The insert 24*a* terminates at a proximal end at an edge 24*a*-10 which is adjacent to the edge of the core 12*c*.

Figure 4:
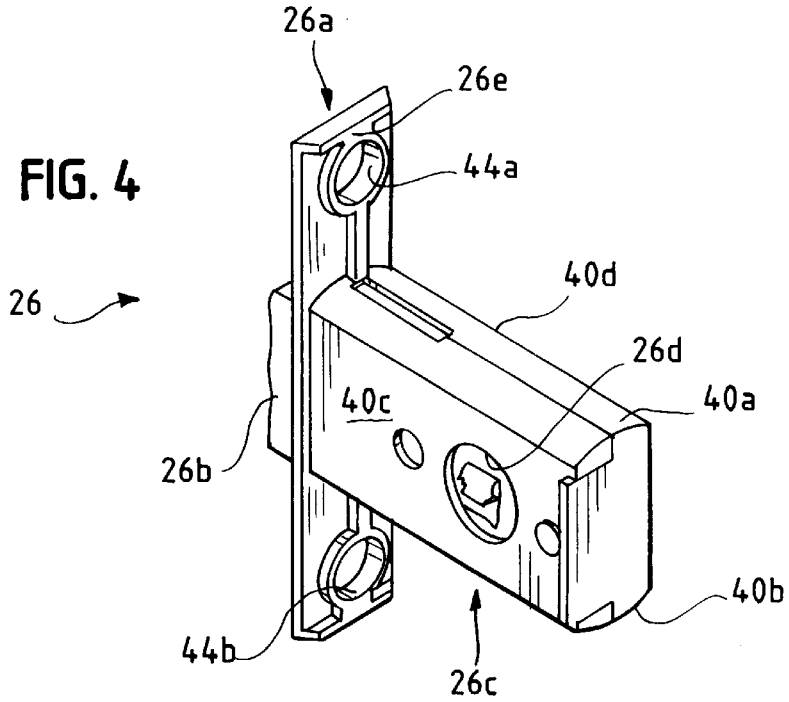
FIG. 4 illustrates an exemplary mortise lock usable in the door of FIG. 1A.

FIG. 4 illustrates additional details of exemplary lock 26. As illustrated in FIG. 4, the mortise lock 26 incorporates a housing 26*c* having first and second spaced apart curved side walls 40*a*, 40*b* joined by spaced apart planer walls 40*c*, 40*d*. When slidably installed in a respective insert, best seen in FIGS. 5B, C such as the insert 24*a*, the side walls 40*c*, 40*d* of the mortise lock 26, slidably engage respective interior surfaces of the side walls 24*a*-5, -6 precluding rotation of the lock 26 relative to the insert 24*a* or *b*.

The housing 26*c* can be formed of metal or plastic. Housing 26*c* can be sealed against moisture so that it could be inserted into slot 20*a* or 20*b* without need of a separate insert, such as insert 24*a, b*. Alternately, the respective insert such as 24*a* can be permanently attached to the lock 26, and the combination can be inserted into the respective door slot or opening.

The height and curvature of the curved side walls 40*a*, 40*b* of the housing 26*c* can correspond to the elongated interior cross section of the inserts 24*a, b*. Alternately, the height of the side walls 40*a*, 40*b* can be less than the interior height between the curved ends 24*a*-3, -4 of the insert 24*a*.

The lock 26 also carries an insertion limiting surface, illustrated as surface 26*e* in FIG. 4. This surface limits the extent to which the housing 26*c* extends into the region 24*a*-8 of the insert 24*a*.

The lock 26 can be retained in the respective insert 24*a, b* by frictional forces. Alternately, openings 44*a* and 44*b* can be provided for screws or other fasteners to mechanically attach the lock 26 to the edge 12*c* of the door 10.

Figure 5A:
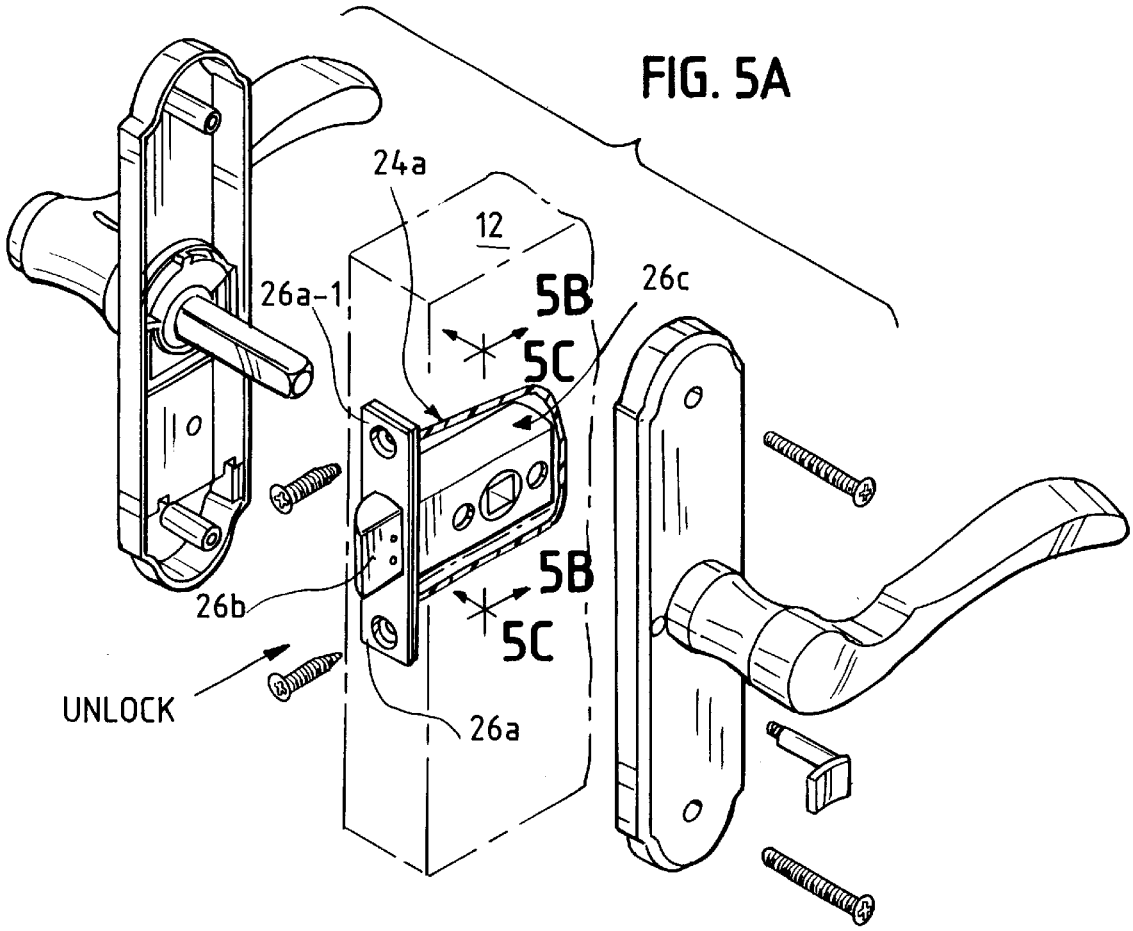
FIG. 5A is an enlarged fragmentary exploded view of a portion of the mortise lock mechanism installed in the door of FIG. 1A.
Figure 5B:
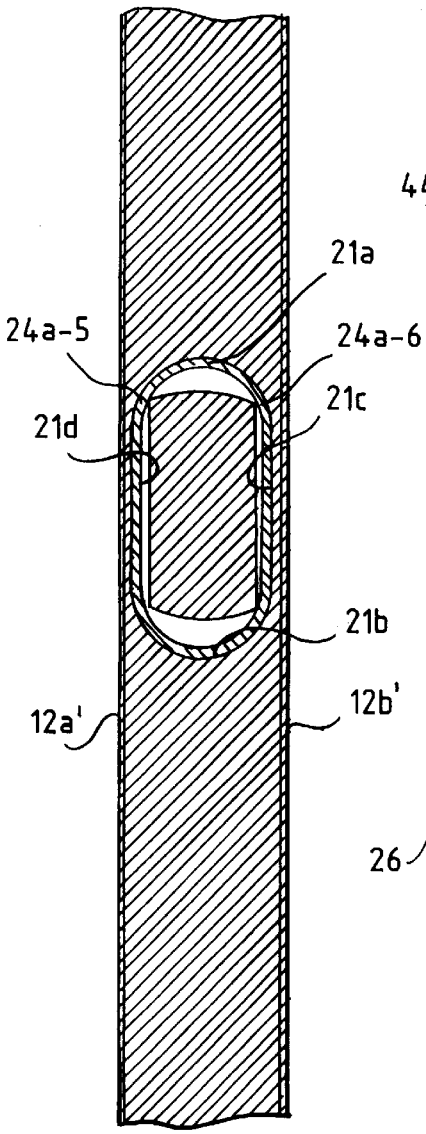
FIG. 5B is a sectional view taken along plane 5B—5B of FIG. 5A.
Figure 5C:
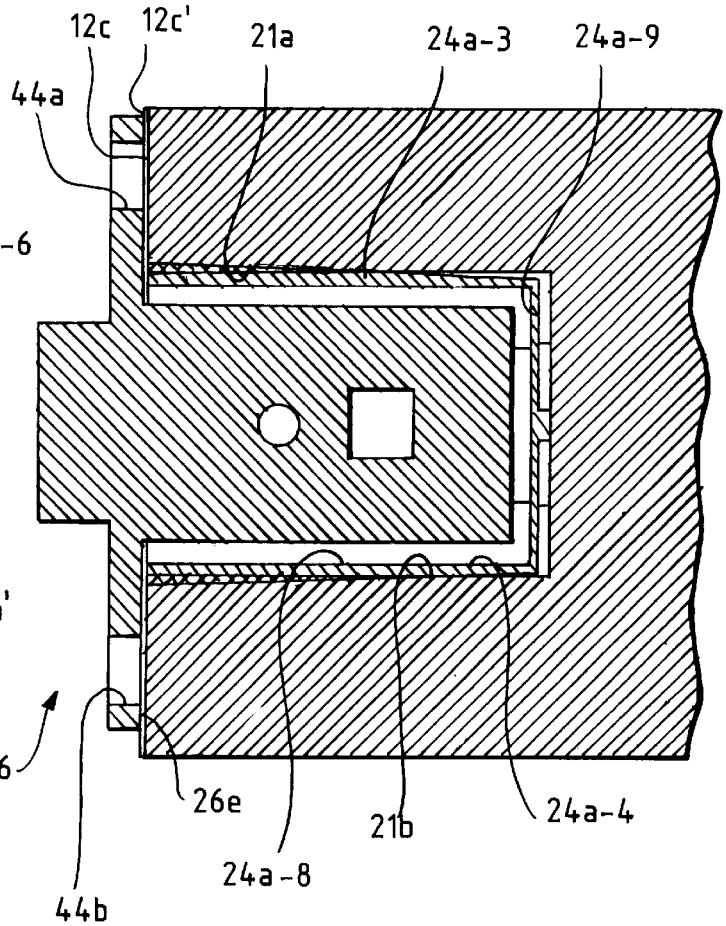
FIG. 5C is a sectional view taken along plane 5C—5C of FIG. 5A.

FIGS. 5A, B, C illustrate further aspects of the relationships between the edge 12*c* of core 12 and the respective elongated opening or slot 20*a*, the respective insert such as the insert 24*a* or b and the respective mortise lock 26. FIGS. 6A–D illustrate details of molded snap-on cover 22.

Figure 6A:
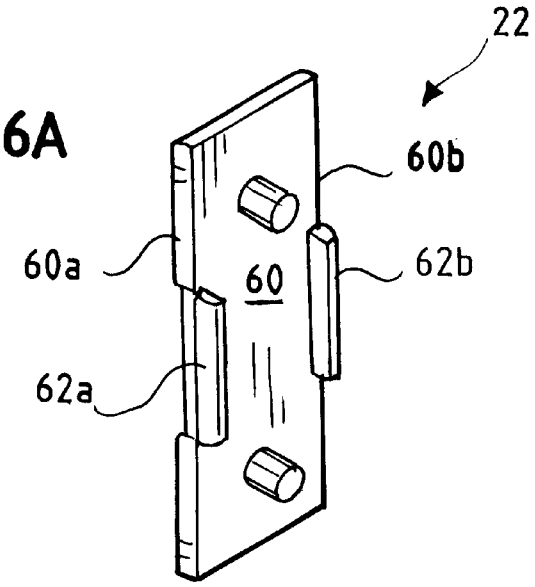
FIGS. 6A–6D illustrate various views of a sleeve closing snap-in cover of a type usable in the door of FIG. 1.
Figure 6D:
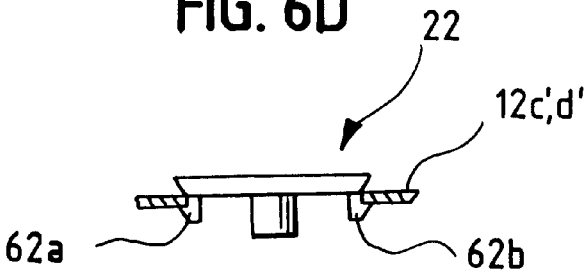
Figure 6C:
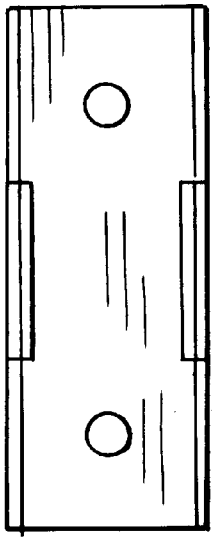
Figure 6B:
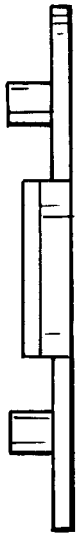

Cover 22 has an elongated rectangular body 60 with spaced apart elongated edges 60*a, b*. Each of the edges 60*a, b* carries respective slidable or snap-engagable flanges 62*a, b*. As illustrated in FIG. 6D, the respective flanges 62*a, b* deflect and engage edges of either exterior edging 12*c'd'* thereby closing an unused one of the slots 20*a, b*.

The following parameter illustrates additional aspects of the present invention which makes it possible to reliably install a mortise lock in a narrow core door on the order of three-quarters inch wide or narrower. In such three-quarter inch cores, the slots 20*a, b* are preferably on the order of five-eights inch wide with five-sixteenths of an inch end radii. Maximum slot length can vary depending on a height parameter of the insert 20*a, b*.

Where height of live bolt 26*b* is in a range of three-quarters to seven-eights of an inch, an interior height of sleeve 24*a, b* on the order of one and one-quarter inch with a width on the order of 0.56 inches will accommodate a lock housing 26*c* on the order of one inch high and one-half inch wide in a five-eighths inch wide slot 20*a, b*. A sleeve with an exterior width of 0.625 inches and 0.030 thick walls will accommodate such a lock housing.

To provide a live bolt 26*b* movable on the order of one-half inch from an extended locking position, illustrated in FIG. 5A, to a fully retracted position against surface 26*a*-1, the rotary axis R can be set back on the order of one and one-eighth inch to accommodate the narrow door width.

Figure 7A:
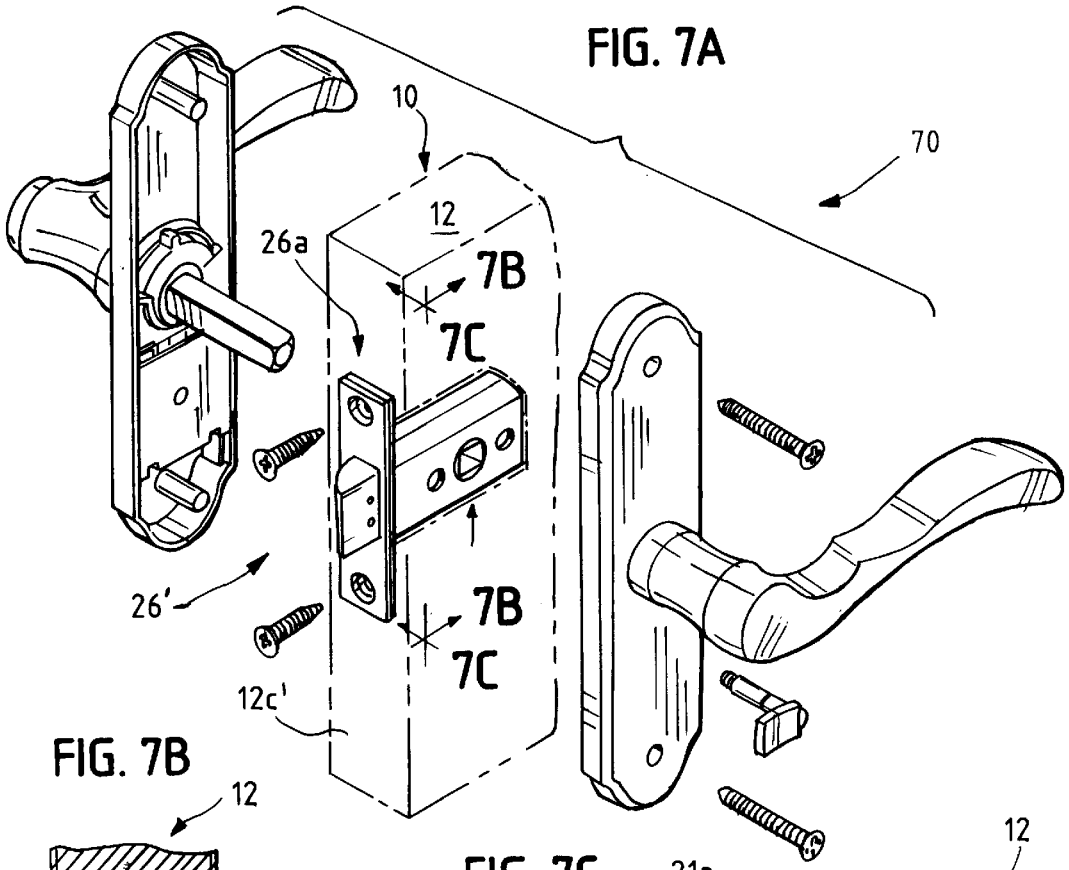
FIG. 7A illustrates an enlarged, isometric view of a portion of a door with an alternate lock embodiment.
Figure 7B:
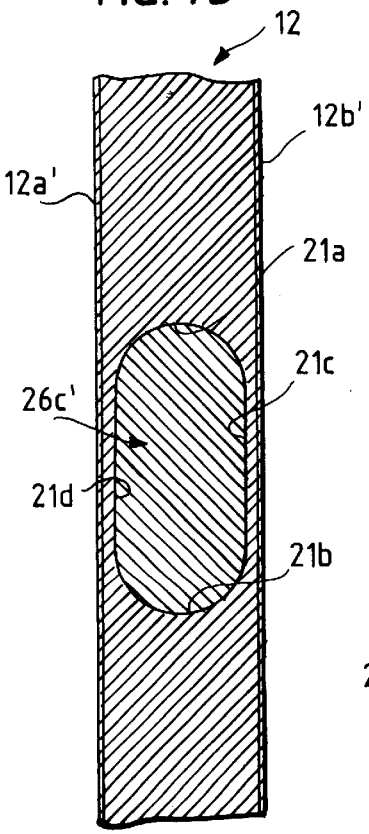
FIG. 7B is a sectional view of the embodiment of FIG. 7A taken along plane 7B—7B.
Figure 7C:
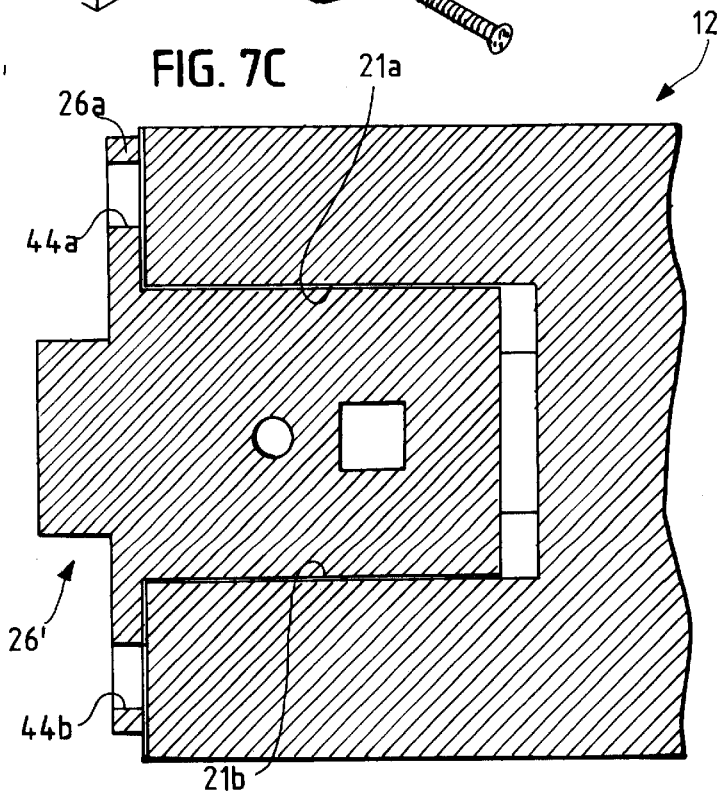
FIG. 7C is a sectional view of the embodiment of FIG. 7A taken along plane 7C—7C.

FIGS. 7A–7C illustrate respectively an exploded and two sectional views of an alternate embodiment of a lock in accordance with the present invention. In the embodiment 70, those elements which are substantially identical to the elements previously discussed have been assigned the same identification numerals. In the embodiment 70, a mortise lock 26' is formed with a housing 26*c'* which can be installed in a door 10 without any need for a sleeve or inserts such as the sleeve or insert 24*a, b*. In this circumstance, the housing 26*c'* completely fills the respective slot 24*a*, 24*b*.

The housing 26*c'* for the lock can be sealed with an integral plastic layer. Alternately, it can be formed of moisture resisting sealed metal or plastic such that when inserted into the respective edge opening it substantially excludes moisture from the respective door core, such as core 12 (which could be a wood or wood-based material susceptible to absorbing moisture.)

Figure 8:
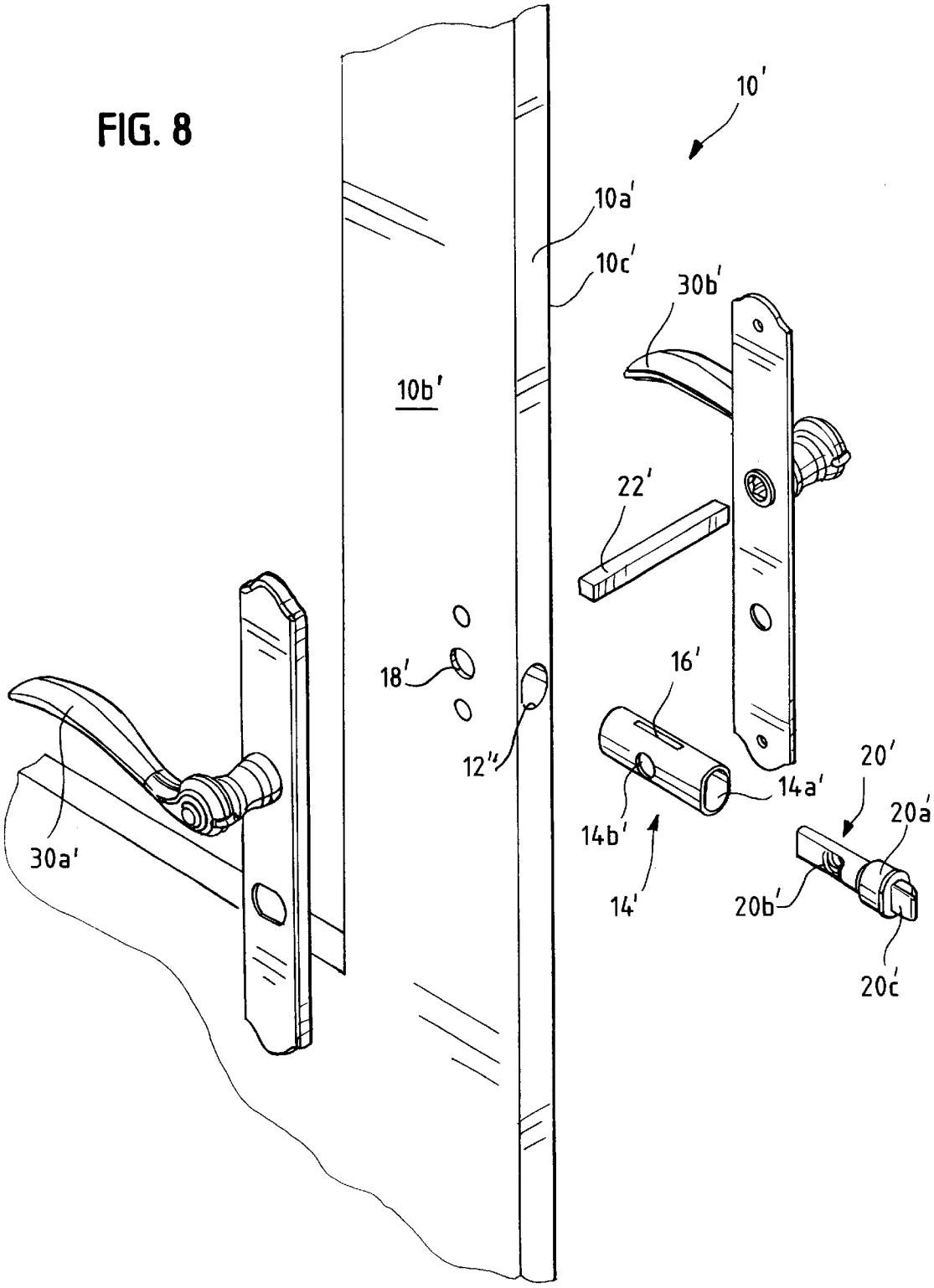
FIG. 8 is an exploded isometric view of an alternate embodiment of the invention.

FIG. 8 illustrates an alternate door 10' which has an elongated oval opening 12" cut into an edge 10*a'* which is adjacent a side of the door frame to which the door is to be locked. For example, the opening 12" could have upper and lower curved edges, such as semicircles, joined by planar side surfaces.

A sleeve 14', molded plastic or metal is driven into the oval opening 12". The sleeve 14' has an external oval cross section which matches the peripheral shape of the oval opening. The sleeve 14' is hollow with a non-circular interior cross section 14*a'*. For example, circular, oval, rectangular or triangular exterior or interior cross sections could be used. The sleeve 14' can carry exterior features, ridges, extensions protrusions or the like 16', to lock the sleeve to the door.

A second opening 18' is cut into faces 10*b', c'* of the door 10'. The faces 10*b', c'* are perpendicular to the edge 10*a'*. The second opening 18' extends between the faces of the door, with a central axis that is parallel to the edge 10*a'* and intersects the oval opening 12".

A latch mechanism 20' which, at least in part, has an exterior peripheral surface 20*a'* which corresponds to the shape of the interior periphery 14*a'* of the sleeve 14' is inserted into the sleeve and retained in place by the sleeve. An actuating shaft opening 20*b'* is located adjacent feature 20*a'*.

The shaft opening 20*b'* in the distal end of the latch mechanism is aligned with the second opening 18', through the faces 10*b', c'* of the door and through a lateral opening 14*b'* in the sleeve 14'. A latch actuating shaft 22' extends through the aligned second opening 18', the lateral opening 14*b'* in the sleeve and the shaft opening 20*b'* through the latch mechanism. Rotating the shaft 22' retracts a latch bolt 20*c'* in the latch mechanism 20' unlocking the door from the frame. Handles can be attached to each end of the shaft 22' on opposite sides of the door 10'.

When the door 10' is closed, the exterior end of the latch bolt 20*c'* extends into the adjacent frame locking the door thereto. Rotating the shaft 22' retracts the exterior end of the latch bolt 20*c'* into the latch mechanism 20' unlocking the door.

During manufacture, the door 10' can be bored not only on the edge 10*a'* but on the opposite edge with an opening such as the opening 12" to receive two sleeves 14' to facilitate reversible lock installation on the door. With this configuration, the door can be readily equipped with a lock set on either edge to provide for either a right-hand swing or a left-hand swing of the door. In this instance, the sleeves 14' could each be closed with a removable cap. When the lock set is installed, the cap can be removed from the appropriate sleeve and the other cap left in place to cover the adjacent sleeve and provide an attractive essentially smooth door edge on the hinged side.

It will also be understood that the sleeves or inserts such as 24*a, b* or 14' can be made part of or attached to the respective mortise lock such as lock 26 or 20'. Alternately, the housing for the respective lock, such as lock 26 or 20' can be formed as a sealed plastic housing which slidably engages an opening round, elongated, square, rectangular, triangular or the like in the edge of the respective door.

The mortise lock 26' can be attached to the door 10 using plate 26*a* and installing screws or other fasteners in openings 44*a, b* into the edge 12*c'* of the door 10.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A door comprising:

a door body which has first and second spaced apart elongated, planar sides wherein the sides are bounded by edges having a predetermined width and at least one elongated, non-circular boring in a first edge;

at least one moisture excluding hollow, lock receiving plastic insert wherein the insert has an exterior profile which slidably mates with the boring and extends laterally into the door body, the insert includes at least one protrusion for engaging the door body.

2. A door comprising:

a door core which has first and second spaced apart elongated, planar sides wherein the sides are bounded by edges having a predetermined width parameter wherein first and second spaced apart, partially curved borings are formed in respective edges;

first and second inserts, wherein each insert is formed of plastic, wherein each insert has an exterior partly curved profile which slidingly mates with a respective boring;

a cover removably attachable to one of a respective edge and a respective insert for closing a respective insert; and a latch mechanism sized to fit, at least in part, in one of the inserts only in the absence of a respective cover, and wherein the latch mechanism can be affixed to the door by at least one of a fastener which extends into a respective adjacent edge or by frictional forces between the respective insert and the mechanism.

3. A door as in claim 2 wherein the latch mechanism has a body portion which has an actuator port displaced from an exterior edge of a respective insert an amount in excess of one inch and wherein the port has a centerline which extends generally perpendicular to the sides, with the port generally aligned with an opening in each side.

4. A door as in claim 3 which includes an actuating shaft which extends through the port and the respective openings in the sides.

5. A door as in claim 3 wherein the insert includes at least one opening aligned with the port.

6. A door as in claim 2 wherein the door has a width parameter less than one inch and the borings have a width parameter on the order of five-eights of an inch.

7. A door as in claim 6 wherein the borings exhibit first and second spaced apart planar sides joined by third and fourth sides.

8. A door as in claim 7 wherein each insert slidably engages a respective pair of planar sides.

9. A door as in claim 2 wherein the latch mechanism carries a fastener receiving feature for attaching the mechanism to the edge of the door with a fastener.

10. A door as in claim 9 wherein the latch mechanism includes a housing, receivable in the insert when the mechanism is attached to the edge of the door and wherein the housing has cross section which is at least in part curved.

11. A door as in claim 10 wherein the inserts each carry a door body engaging protrusion.

12. A door comprising:

a door body which has first and second spaced apart elongated, planar sides wherein the sides are bounded by edges having a predetermined width and at least one elongated, non-circular boring in a first edge;

at least one moisture excluding hollow, lock receiving plastic insert wherein the insert has an exterior profile which slidably mates with the boring and extends laterally into the door body; and a removable cover for the insert.

13. A door as in claim 12 comprising:

a second non-circular boring, substantially the same as the at least one boring in a second, parallel edge, a second insert substantially the same as the at least one insert; and a second cover for removably closing the second insert.

14. A door as in clam 12 wherein the boring has first and second curved surface joined by first and second parallel planar surfaces.

15. A door as in claim 14 wherein the insert comprises first and second curved ends joined by first and second spaced apart, planar, parallel walls and at least one axially oriented, laterally extending, door engaging protrusion.

16. A door as in claim 15 which includes a latch mechanism carried at least in part in the insert.

17. A door as in claim 16 wherein the mechanism includes a housing carried in the insert and a latch which extends therefrom.

18. A door as in claim 17 wherein the housing, at least in part, slidably engages the insert.

19. A door comprising:

a moisture absorbing door core which has first and second spaced apart elongated, planar sides wherein the sides are bounded by edges having a predetermined width parameter wherein first and second spaced part, at least partially curved borings are formed in respective edges;

at least one insert, wherein the insert is formed of plastic, wherein the insert has an exterior profile which slidingly mates with a respective boring;

a latch mechanism sized to fit, at least in part, in one of the inserts, and wherein the latch mechanism can be affixed to the door by at least one of a fastener which extends into a respective adjacent edge or by frictional forces between the respective insert and the mechanism, and wherein the insert forms a seal which excludes moisture from the core.

20. A door as in claim 19 wherein the door has a width parameter less than one inch and the borings have a width parameter on the order of five-eighths of an inch.

21. A door as in claim 19 wherein the borings exhibit first and second spaced apart planar sides joined by third and fourth curved sides.

22. A door as in claim 19 wherein the latch mechanism is fixedly attached to the insert forming an integral unit therewith.

23. A door as in claim 19 wherein the latch mechanism includes a housing, removably receivable in the insert when the mechanism is inserted into the edge of the door and wherein the housing has a cross section which is at least in part curved.

24. A door as in claim 19 wherein the insert comprises a substantially sealed housing for the latch mechanism.

25. A door comprising:

a door body which has first and second spaced apart elongated, planar sides wherein the sides are bounded by edges having a predetermined width and at least one elongated non-circular boring in a first edge;

at least one moisture excluding, mortise lock wherein the lock has an exterior profile which slidably mates with the boring, extends laterally into the door body and substantially fills the boring to substantially exclude exterior moisture from the door body.

26. A door comprising:

a door body which has first and second spaced apart elongated, planar sides wherein the sides are bounded by edges having a predetermined width and at least one elongated non-circular boring in a first edge;

at least one moisture excluding, mortise lock wherein the lock has an exterior profile which slidably mates with the boring and extends laterally into the door body and substantially fills the boring;

a second non-circular boring, substantially the same as the at least one boring in second, parallel edge; and a removable cover for closing a selected boring.

27. A door comprising:

a moisture absorbing core which has first and second spaced apart elongated, planar sides wherein the sides are bounded by edges having a predetermined width and at least one elongated opening in a first edge;

at least one moisture excluding mortise lock wherein the lock has an exterior profile which slidably mates with the opening and extends laterally into the core and wherein the lock seals the core and blocks an influx of exterior moisture from entering the opening, and, wherein the lock includes a removable moisture resistant insert which substantially fills and seals the opening and contains a lock mechanism wherein an inflow of exterior moisture and the lock mechanism is blocked from being absorbed by the core.

28. A door as in claim 27 where the lock is slidably received in the insert.

29. A door comprising:

a moisture absorbing door core which has first and second spaced apart elongated, planar sides wherein the sides are bounded by edges having a predetermined width parameter with at least one partially curved boring located in one of the edges;

at least one insert, wherein the insert is formed of plastic, wherein the insert has an exterior profile which slidingly mates with the at least one boring;

a latch mechanism sized to fit, at least in part, in the insert where the latch mechanism can be affixed to the door by at least one of a fastener, or, by frictional forces between the respective insert and the mechanism, and wherein the insert forms a seal which excludes moisture from the core.

30. A door as in claim 29 where the core has a width parameter less than one inch and the borings have a width parameter on the order of five-eights of an inch.

31. A door as in claim 29 where the borings exhibit first and second spaced apart planar sides joined by third and fourth curved sides.

32. A door as in claim 29 where the latch mechanism is fixedly attached to the insert forming an integral unit therewith.

33. A door as in claim 29 where the latch mechanism includes a housing, removably receivable in the insert and wherein the housing has a cross section which is at least in part curved.

34. A door as in claim 29 where the insert comprises a substantially sealed housing for the latch mechanism.

* * * * *